US007703665B2

(12) United States Patent
McGowan

(10) Patent No.: US 7,703,665 B2
(45) Date of Patent: Apr. 27, 2010

(54) DISPENSING CARTON

(75) Inventor: Gregory Hallenbeck McGowan, Hooksett, NH (US)

(73) Assignee: Graphic Packaging International, Inc., Marietta, GA (US)

( * ) Notice: Subject to any disclaimer, the term of this patent is extended or adjusted under 35 U.S.C. 154(b) by 924 days.

(21) Appl. No.: 11/454,445

(22) Filed: Jun. 16, 2006

(65) Prior Publication Data

US 2006/0289616 A1 Dec. 28, 2006

Related U.S. Application Data

(60) Provisional application No. 60/691,695, filed on Jun. 17, 2005.

(51) Int. Cl.

| | |
|---|---|
| ***B65D 5/72*** | (2006.01) |
| ***B65D 5/00*** | (2006.01) |
| ***B65D 5/12*** | (2006.01) |
| ***B65D 17/00*** | (2006.01) |
| ***A47F 1/04*** | (2006.01) |

(52) U.S. Cl. ..... 229/122.1; 229/122; 229/243; 221/302; 221/305

(58) Field of Classification Search ..... 229/122.1, 229/122, 243; 221/302, 305
See application file for complete search history.

(56) References Cited

U.S. PATENT DOCUMENTS

| | | | | |
|---|---|---|---|---|
| 291,281 | A * | 1/1884 | Blakely | 229/150 |
| 640,766 | A * | 1/1900 | Hibson | 229/147 |
| 1,850,254 | A * | 3/1932 | Zimmerman | 229/122.1 |
| 2,306,328 | A * | 12/1942 | Biberthaler | 229/150 |
| 2,907,512 | A * | 10/1959 | Leone | 229/122.1 |
| 3,133,634 | A * | 5/1964 | Bulovic | 206/216 |
| 3,944,128 | A * | 3/1976 | Hogan | |
| 4,186,866 | A * | 2/1980 | Zicko | |
| 4,283,000 | A * | 8/1981 | White | |
| 4,752,029 | A * | 6/1988 | Buford | 229/122.1 |
| 4,805,765 | A * | 2/1989 | Barrett et al. | 206/738 |
| 5,458,272 | A * | 10/1995 | Ward-Weber | 229/122.1 |
| 5,626,283 | A * | 5/1997 | Mellon | 229/120.13 |
| 5,813,597 | A * | 9/1998 | Wakevainen | |
| 6,923,365 | B2 * | 8/2005 | Auclair et al. | 229/120.011 |
| 6,951,300 | B2 * | 10/2005 | Caille et al. | |
| 7,066,380 | B2 * | 6/2006 | Blake | 229/122.1 |

FOREIGN PATENT DOCUMENTS

| | | | |
|---|---|---|---|
| DE | 297 12 817 | U1 * | 11/1997 |
| EP | 1 306 309 | A1 * | 5/2003 |

* cited by examiner

*Primary Examiner*—Gary E Elkins
*Assistant Examiner*—Latrice Byrd
(74) *Attorney, Agent, or Firm*—Womble Carlyle Sandridge & Rice, PLLC

(57) ABSTRACT

A carton accommodates stacked, articles. The carton has a pivoting dispenser that allows the articles to be dispensed from the front of the carton. The bottom panel can be erected using relatively simple folding operations.

24 Claims, 6 Drawing Sheets

DISPENSING CARTON

RELATED APPLICATION

This application claims the benefit of U.S. Provisional Application No. 60/691,695, filed Jun. 17, 2005, the entire contents of which are hereby incorporated by reference.

BACKGROUND

Dispensing cartons having pivoting dispensers are known. The cartons may accommodate discrete dispensable items through a dispenser opening. Such cartons are typically formed from a blank having front, side and back panels, and a plurality of top and bottom flaps for closing the top and bottom ends of the carton, respectively. The bottom flaps are typically of a complex interlocking configuration, which may require manual closure and/or the use of complex machinery to close the bottom end of the carton.

SUMMARY

According to first embodiment, a carton comprises a back panel, a first side panel, a second side panel, a front panel, and a bottom panel. A pivotable dispenser is formed in the front panel. The bottom panel covers essentially all of a bottom opening of the carton, and may be constructed from a substantially rectangular panel.

According to one aspect of the invention, the bottom of the carton may be closed by one or more simple folding operations. For example, if bottom side flaps are included in the carton blank, the bottom of the carton may be closed by folding the bottom side flaps inwardly and then folding the bottom panel over the bottom side flaps. The carton bottom can be closed without, for example, the use of adhesives or other chemical joining means.

Other aspects, features, and details of embodiments of the present invention can be more completely understood by reference to the following detailed description of preferred embodiments, taken in conjunction with the drawings figures and from the appended claims.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

The present embodiments are addressed to a dispensing carton having a pivoting dispenser and a bottom panel that is easily constructed.

Figure 1:
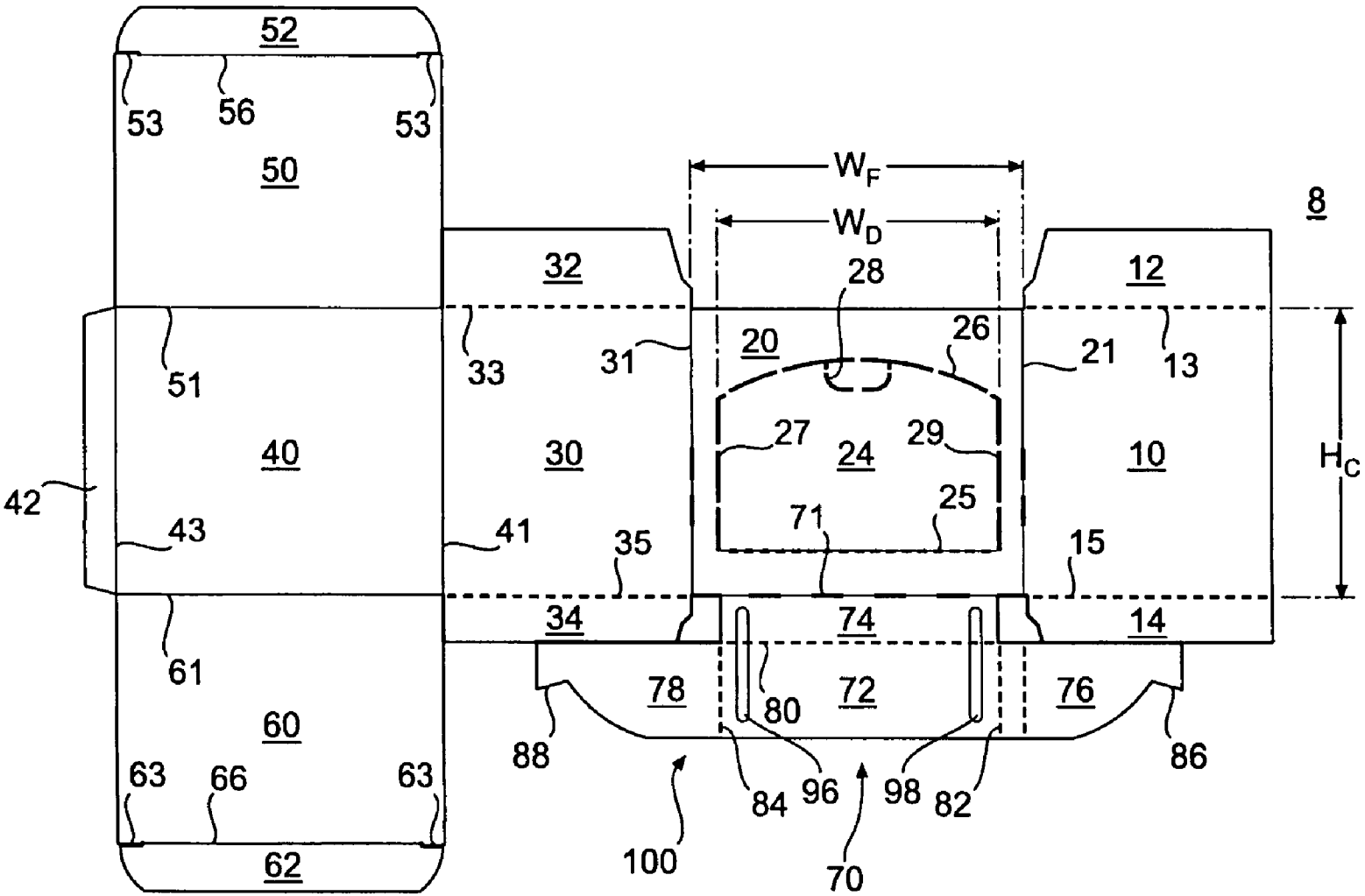
FIG. 1 is a plan view of a blank used to form a carton having a dispenser according to a first embodiment of the invention.

FIG. 1 is a plan view of a first, exterior side of a blank 8 used to form a carton 150 (illustrated in FIGS. 4-7) according to a first embodiment of the invention. The first side will be disposed on the exterior of the erected carton 150. The blank 8 comprises a first side panel 10 foldably connected to a front panel 20 at a first transverse fold line 21, a second side panel 30 foldably connected to the front panel 20 at a second transverse fold line 31, a back panel 40 foldably connected to the second side panel 30 at a third transverse fold line 41, a top panel 50 foldably connected to the back panel 40 at a longitudinal fold line 51, and a bottom panel 60 foldably connected to the back panel 40 at a longitudinal fold line 61.

The first side panel 10 is foldably connected to a first top side flap 12 and a first bottom side flap 14. The second side panel 30 is foldably connected to a second top side flap 32 and a second bottom side flap 34. The first and second top side flaps 12, 32 may be foldably connected at longitudinal fold lines 13, 33, respectively. The top panel 50 is foldably connected to a top tuck or closure flap 52 at a longitudinal fold line 56 that may include cuts 53 at opposite ends of the fold line. The back panel 40 is foldably connected to an adhesive panel 42 at a transverse fold line 43.

The first and second bottom side flaps 14, 34 may be foldably connected at longitudinal fold lines 15, 35, respectively. According to one aspect of the invention, the first and second bottom side flaps 14, 34 are substantially smaller than the bottom panel 60, and are intended to be disposed within the carton interior with respect to the bottom panel 60. According to one aspect of the invention, the bottom side flaps 14, 34 can be less than half the size of the bottom panel 60. The bottom panel 60 is foldably connected to a bottom tuck or closure flap 62 at a longitudinal fold line 66 that may include cuts 63 at opposite ends of the fold line 66.

According to one aspect of the invention, the blank 8 includes a dispenser pattern 100 defining a first, front or outer dispenser panel 24, and a second, inner dispenser panel 70. The dispenser pattern 100 defines a dispenser 160 in the erected carton 150 (illustrated in FIGS. 4-7). The outer dispenser panel 24 is defined by a longitudinal fold line 25, a curved cut-space line 26, and transverse cut-space lines 27, 29 in the front panel 20. An access line 28 may also be formed in the front dispenser panel 24.

The inner dispenser panel 70 is foldably attached to a bottom edge of the front panel 20 at a longitudinal fold line 71, and includes a base panel 74, an inner pivot panel 72, and first and second side extensions 76, 78. The first and second side extensions 76, 78 are foldably connected to opposite sides of the inner pivot panel 72 at transverse fold lines 82, 84, respectively. The first and second side extensions 76, 78 include respective first and second stops 86, 88 that limit the outward extension of the pivoting panels 24, 72 from the erected carton 150.

The perimeter lines 26, 27, 29 defining the upper portion of the front dispenser panel 24 and the access line 28 are illustrated as cut-space lines. Other lines of disruption such as cuts, or breachable lines of disruption such as cut-score lines or score lines or tear lines in general can be used to define the upper perimeter of the outer dispenser panel 24. Reference numbers 96 and 98 illustrate exemplary adhesive locations that can be used to adhere the panels 72, 74 to the panels 24, 20, respectively, as discussed in further detail below.

The panels 24, 74, 72 have a width $W_D$, which generally indicates a width of the dispenser 160 or the dispenser opening in the erected carton 150. The front panel 20, as well as the back panel 40, has a width $W_F$. The panels 10, 20, 30, 40 have a height of $H_C$, which generally corresponds to the height of the erected carton 150. The front and back panels 20, 40 are wider than the side panels 10, 30.

Figure 2:
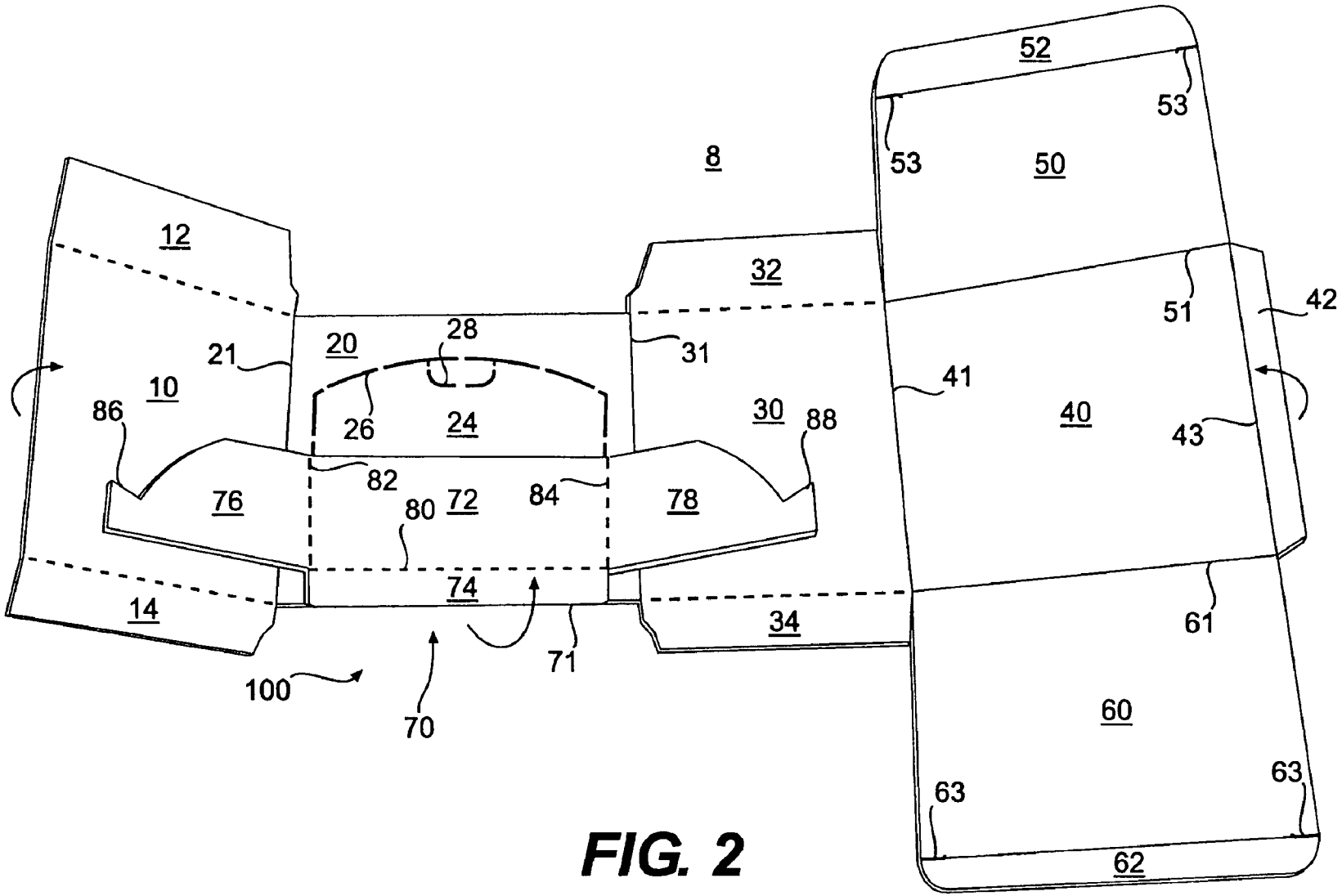
FIG. 2 illustrates a folding and adhering step during erection of the first carton embodiment.

An exemplary method of erection of the carton 150 will now be discussed with reference to FIGS. 2-4. FIG. 2 is a perspective view of the interior side of the carton blank 8 during an initial folding an adhesion step. During erection, the inner dispenser panel 70 is folded upwardly about the longitudinal fold line 71 so that the inner pivot panel 72 contacts the outer pivoting dispenser panel 24. Adhesive may, for example, be applied at the locations 96, 98 shown in FIG. 1 so that the outer and inner panels 24, 72 adhere to one another and so that the panels 74, 20 adhere together below the panel 24.

Figure 3:
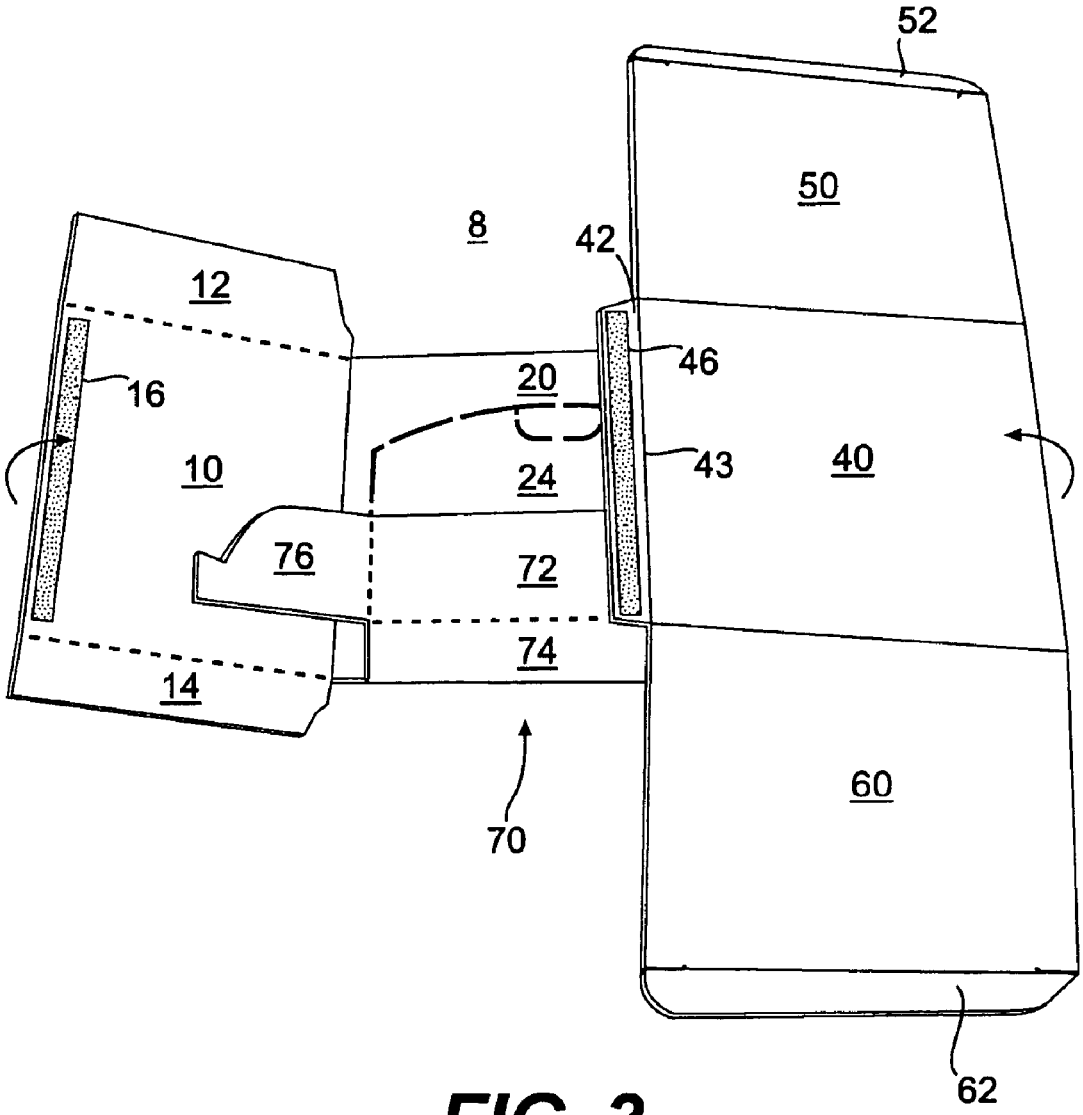
FIG. 3 illustrates a folding step during erection of the first carton embodiment.

Referring to FIG. 3, glue or other adhesive may be applied to the exterior side of the adhesive panel 42 at the area indicated by reference number 46, or to the interior side of the first side panel 10 at the area indicated by reference number 16, or to both areas. The back panel 40 may then be adhered to the first side panel 10 via the adhesive panel 42. FIG. 4 illustrates the blank 8 with the interior side of the first side panel 10 adhered to the adhesive panel 42. The folded and glued blank 8 may then be opened to obtain a generally tubular configuration or form with open upper and lower ends.

According to one aspect of the invention, the bottom of the carton may be closed by relatively simple folding operations. Referring back to FIG. 1, the bottom of the carton 150 can be closed by folding the bottom side flaps 14, 34 inwardly about the longitudinal fold lines 15, 35, respectively. The bottom panel 60 is then folded inwardly about the longitudinal fold line 61 so that the bottom panel 60 closes all or substantially all of the bottom end of the carton, with the bottom side flaps 14, 34 disposed in the carton interior with respect to the bottom panel 60. The bottom panel 60 may be secured in place by tucking in the bottom closure flap 62 so that it abuts the front panel 20, or more precisely, the inner dispenser panel 70, which is adhered to the front panel 20. The cuts 63 at either side of the fold line 66 may help secure the bottom panel 60 in place. The bottom panel 60 may be rectangular or generally rectangular in shape, for example, and may serve to close all or substantially all of the entirety of the bottom end of the carton.

Similarly, the open top end of the carton can be closed by folding the top side flaps 12, 32 and the top panel 50 inwardly. The top panel 50 may be secured in place by tucking in the top closure flap 52.

Figure 5:
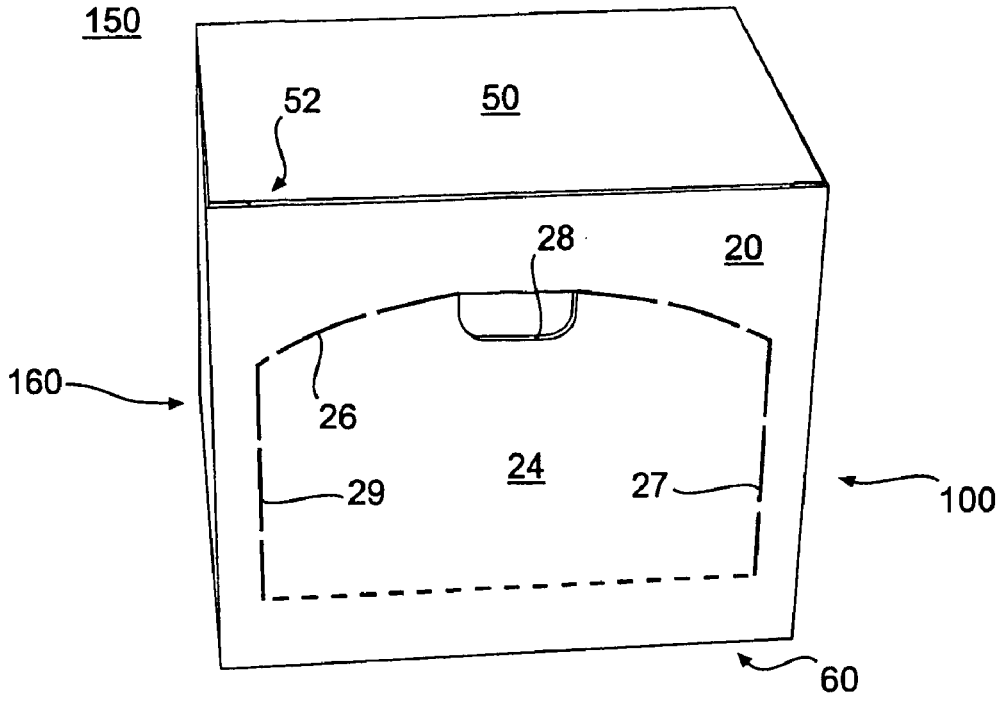
FIG. 5 illustrates the first carton embodiment.

FIG. 5 illustrates the carton 150 erected from the blank 8. In the carton 150, the dispenser pattern 100 defines a dispenser 160. In FIG. 5, the access line 28 has been breached, leaving an access opening in the outer dispenser panel 24. If the access line is a cut-space line, the line 28 may be breached by pressing in at the area defined between the lines 28 and 26. Alternatively, the access line 28 may be a continuous cut and the upper middle section of the line 26 may be a continuous cut, the cuts defining a cutout aperture in the front panel 24.

Figure 6:
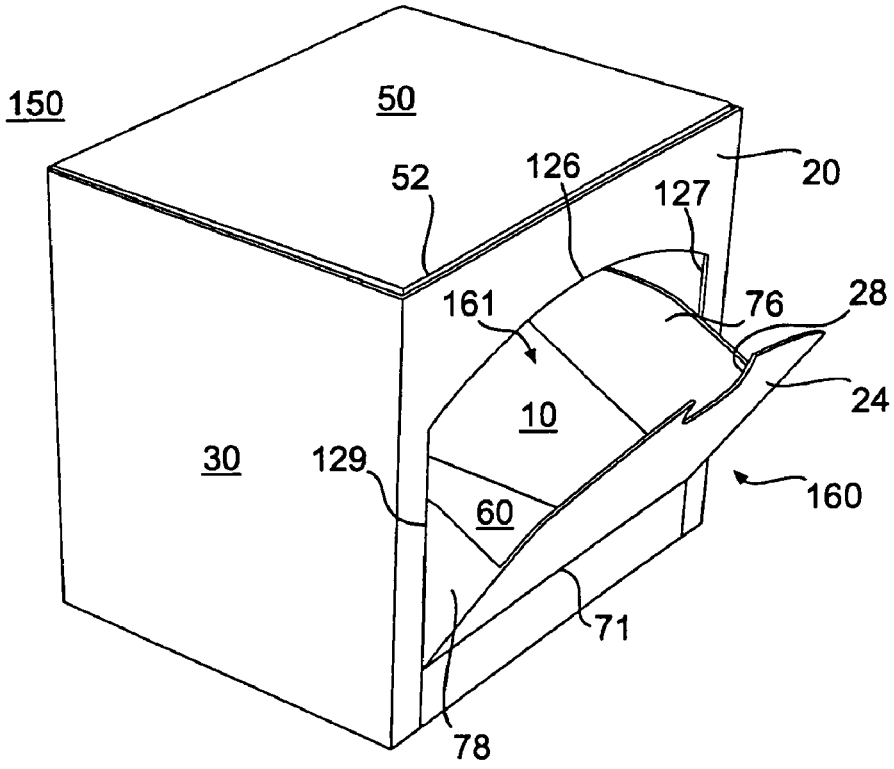
FIG. 6 illustrates the first carton embodiment with the dispenser open.

FIG. 6 illustrates the carton 150 with the dispenser 160 opened. The dispenser 160 may be opened by pulling the pivoting outer dispenser panel 24 outwardly at the access opening and tearing the front panel 20 at the vertical lines 27, 29 of the dispenser pattern 100. The inner pivot panel 72 (shown in FIGS. 1 and 2) of the inner dispenser panel 70 is adhered to the outer panel 24 and therefore also pivots outwardly. The first and second stops 86, 88 on the first and second side extensions 76, 78 abut the inner surface of the front panel 20 at the outermost pivot point of the dispenser 160 and thereby limits the outward pivot of the dispenser 160 from the front panel 20. Pulling the dispenser 160 open leaves a dispenser opening 161 in the front panel 20. The dispenser opening 161 has a curved upper edge 126 and vertical side edges 127, 129 formed by the breached dispenser pattern 100.

Figure 7:
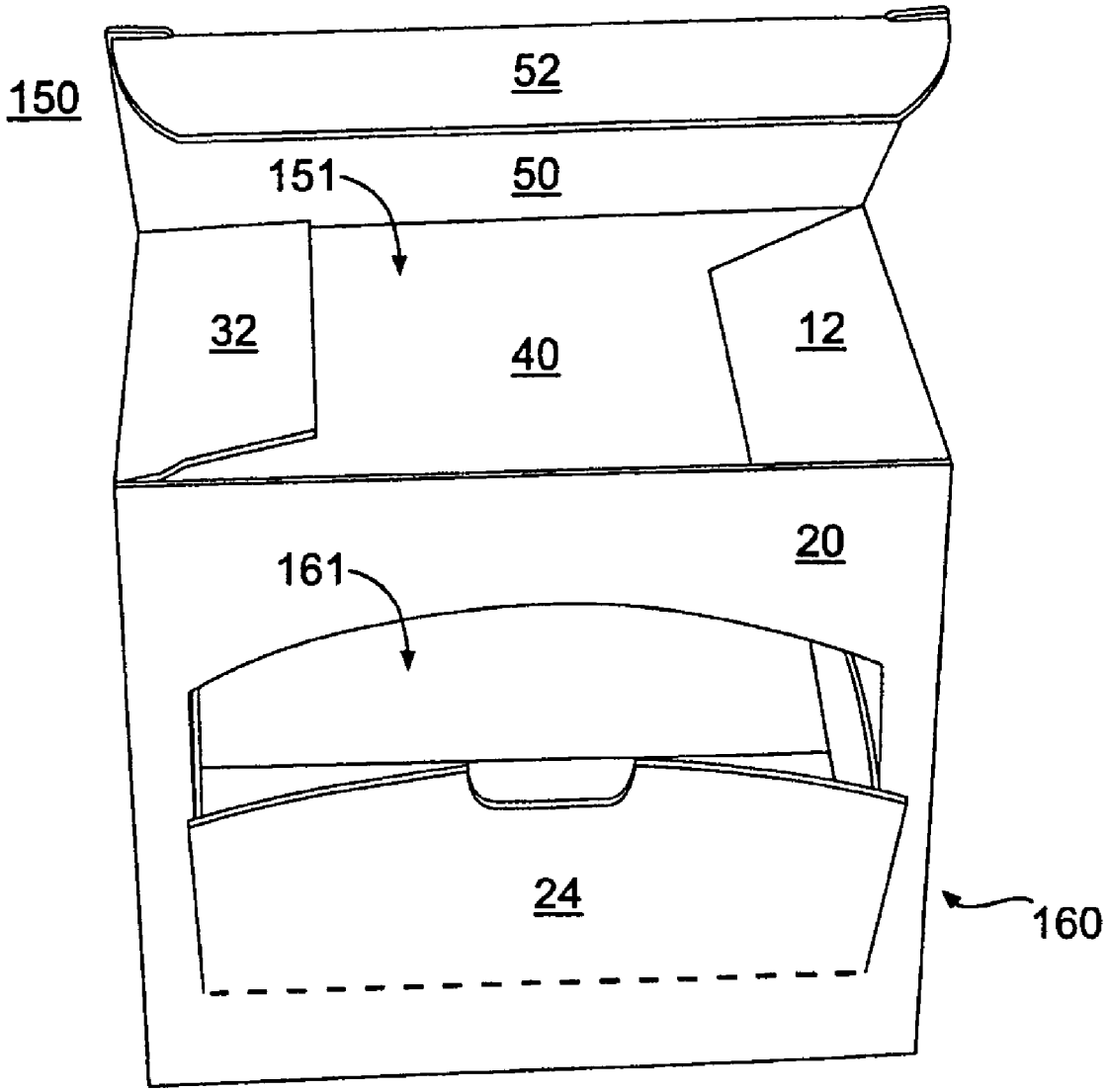
FIG. 7 illustrates the first carton embodiment with the dispenser open and the top of the carton open.

FIG. 7 illustrates the carton 150 with the top panel 50 opened and the dispenser 160 opened. Opening the top panel 50 leaves a loading opening 151 through which articles may be loaded into the carton 150. For example, the carton 150 can be loaded with articles through the open top of the carton after erecting the carton 150. Alternatively, the carton 150 may be loaded with articles during erection of the carton 150.

EXAMPLE

Figure 4:
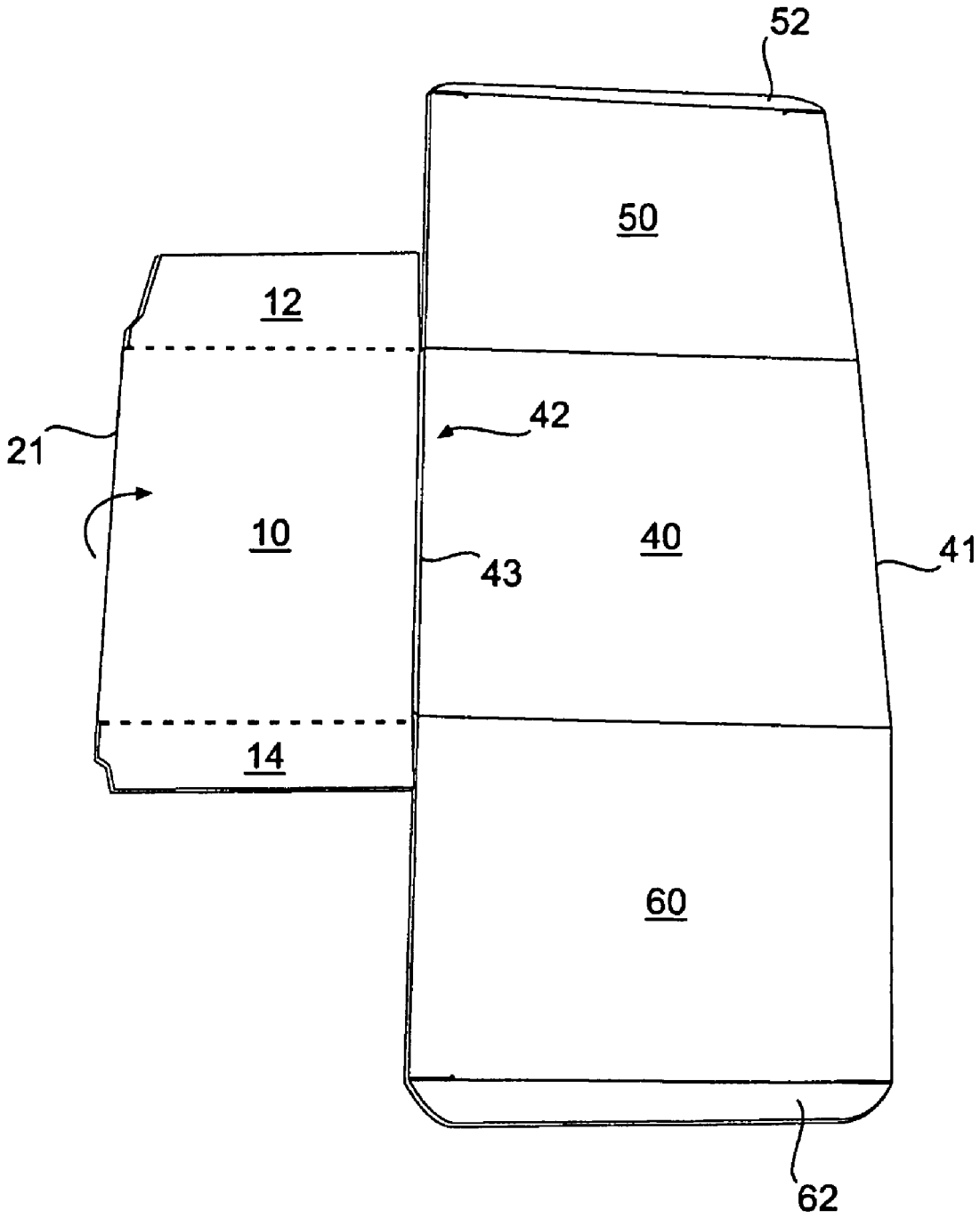
FIG. 4 illustrates a folding and adhering step during erection of the first carton embodiment.

A carton 150 as illustrated in FIG. 4 was constructed from a blank 8 as illustrated in FIG. 1. The carton 150 had height $H_C$ of about 4.6 inches and a front panel width $W_F$ of about 5.2 inches. The width $W_D$ of the outer dispenser panel 24 was about 4.45 inches.

According to one aspect of the above embodiment, articles can be stored in a secure, enclosed carton 150, and dispensed through the pivoting dispenser 160. The bottom of the carton 150 is closed by a relatively simple bottom panel closure that requires only simple folding operations. The top and/or bottom ends of the carton 150 may be closed without, for example, the use of adhesive or other chemical joining means. Because the carton 150 can be closed without the use of special machines, complex operations, or adhesives, dispensable items can be loaded into the carton at any time. Therefore, the carton 150 may be assembled and filled even after delivery to the ultimate consumer. For example, if the carton 150 is used as a dispensing carton for displaying items at a retail store, articles may be loaded into the carton after delivery of the carton to a retail facility. The simple bottom closure allows even users unfamiliar with the carton to easily erect the carton 150. Once articles are loaded into the carton 150, the top and/or bottom of the carton may be closed, and the dispenser 160 may be opened so that consumers can access dispensable articles in the carton 150. Also, after the articles are dispensed from the carton 150, additional articles may be easily placed in the carton 150 for dispensing by opening the top panel 50.

In an alternative embodiment, glue strips having removable coverings may be applied to the blank 8 at any or all of the adhesive locations 96, 98, 16, 46 (FIGS. 1 and 3). The removable glue strip coverings may be removed, for example, immediately prior to assembly of the blank 8 into a display carton. In this embodiment, the blank 8 can be, for example, delivered to a retail store as a flat blank, and the carton 150 can be assembled by hand using the glue strips. Other forms of manually applicable adhesive may also be used.

In accordance with the exemplary embodiments, the carton may be constructed of paperboard, for example. The paperboard sheets used to form the blank may be thicker and heavier than ordinary paper. The blank, and thus the carton, can also be constructed of other materials, such as cardboard, or any other material having properties suitable for enabling the carton to function at least generally as described above. For example, the blank may be formed from coated solid unbleached sulfate (SUS) board. The blank can also be laminated to or coated with one or more sheet-like materials at selected panels or panel sections.

One or more panels of the blank discussed above can be coated with varnish, clay, or other materials, either alone or in combination. The coating may then be printed over with product, advertising, and other information or images. The blank may also be coated to protect any information printed on the blank. The blank may be coated with, for example, a moisture barrier layer, on either or both sides of the blank.

In accordance with the exemplary embodiments, a fold line can be any substantially linear, although not necessarily straight, form of weakening that facilitates folding thereal-ong. More specifically, but not for the purpose of narrowing the scope of the present invention, fold lines include: a crease, such as formed by folding; a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or panels adhered together by glue. The term "glue" is intended to encompass all manner of adhesives commonly used to secure carton panels in place.

For purposes of the description presented herein, the term "line of disruption" can be used to generally refer to a cut line, a score line, a tear line, a crease line, perforations, a fold line, or other disruptions formed in a blank (or a combination of at least one cut line, score line, tear line, crease line, and/or fold line, or other disruptions). A "breachable" line of disruption as disclosed in the specification refers to a line of disruption that is intended to be breached or otherwise torn during ordinary use of a carton.

In the present specification, a "panel" need not be flat or otherwise planar. A "panel" can, for example, comprise a plurality of interconnected generally flat or planar sections.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein.

What is claimed is:

1. A carton, comprising:

a back panel;

a first side panel;

a second side panel;

a front panel;

a bottom panel comprising a substantially rectangular panel covering substantially all of a bottom opening of the carton;

a dispenser formed at least in the front panel, the dispenser comprising an outer pivoting dispenser panel formed from the front panel, and an inner dispenser panel foldably connected to a bottom edge of the front panel and attached to an inner surface of the front panel; and a tuck panel foldably connected to the bottom panel, the tuck panel being tucked into an interior of the carton and abutting the inner dispenser panel, wherein when the dispenser is opened, a dispenser opening is left in the front panel as the outer dispenser panel pivots away from the front panel and allows access to the interior of the carton.

2. The carton of claim 1, further comprising a first side bottom flap extending from the first side panel and a second side bottom flap extending from the second side panel, the first and second side bottom flaps extending at least partially across the bottom opening.

3. The carton of claim 2, wherein the bottom panel overlaps the first side bottom flap and the second side bottom flap, and substantial entireties of both side bottom flaps are disposed in the carton interior with respect to the bottom panel.

4. The carton of claim 1, wherein a pivoting portion of the inner dispenser panel is adhered to an inner surface of the outer dispenser panel.

5. The carton of claim 4, wherein the dispenser further comprises:

a first side extension foldably connected to a first side of the inner dispenser panel; and a second side extension foldably connected to a second side of the inner dispenser panel.

6. The carton of claim 5, further comprising a pivotably mounted top panel at least partially closing a top end of the carton.

7. The carton of claim 6, wherein the carton is substantially parallelepipedal, with the front panel being wider than the side panels.

8. The carton of claim 1, wherein the outer dispenser panel is pivotable outwardly about a horizontal fold line disposed at a bottom edge of the outer dispenser panel.

9. The carton of claim 8, wherein the carton is substantially parallelepipedal, with the front panel being wider than the side panels.

10. A substantially parallelepipedal carton, comprising:

a back panel;

a first side panel;

a second side panel;

a front panel;

a top panel;

a bottom panel at least partially covering a bottom of the carton;

a first side bottom flap extending from the first side panel; and a second side bottom flap extending from the second side panel, the first and second side bottom flaps extending at least partially across the carton bottom and abutting the bottom panel, wherein substantial entireties of both side bottom flaps are disposed in the carton interior with respect to the bottom panel, wherein a dispenser is formed at least in the front panel, the dispenser comprising an outer pivoting dispenser panel formed from the front panel and pivotable about a horizontal fold line adjacent to a bottom of the front panel, and an inner dispenser panel foldably connected to a bottom edge of the front panel, the inner dispenser panel comprising a base panel directly foldably connected to the front panel and attached to an inner surface of the front panel, and the inner dispenser panel comprising an inner pivoting panel foldably connected to the base panel and attached to an inner surface of the outer pivoting dispenser panel, and wherein when the dispenser is opened, a dispenser opening is left in the front panel as the outer dispenser panel pivots away from the front panel and allows access to an interior of the carton.

11. The carton of claim 10, wherein the dispenser further comprises:

a first side extension foldably connected to a first side of the inner dispenser panel; and a second side extension foldably connected to a second side of the inner dispenser panel.

12. The carton of claim 11, further comprising a tuck flap foldably connected to the bottom panel, wherein the tuck flap is tucked into the carton interior.

13. The carton of claim 11, wherein the carton is substantially parallelepipedal, with the front panel being wider than the side panels.

14. A carton blank, comprising:

a back panel;

a first side panel;

a second side panel;

a front panel;

a top panel;

a bottom panel;

a tuck flap foldably connected to the bottom panel;

at least one bottom flap, wherein each at least one bottom flap is less than half a size of the bottom panel; and an inner dispenser panel extending from a bottom edge of the front panel, wherein a dispenser pattern is formed at least in the front panel, the dispenser pattern defining an outer dispenser panel in the front panel, wherein the inner dispenser panel is foldably connected at the bottom edge of the front panel so that the inner dispenser panel is foldable upward to contact the outer dispenser panel, and wherein the tuck flap is foldable upward to abut the inner dispenser panel.

15. The carton blank of claim 14, wherein the bottom panel extends from a bottom edge of the back panel.

16. The carton blank of claim 15, wherein the bottom panel is of about the same width as the back panel.

17. The carton blank of claim 14, wherein the inner dispenser panel comprises:

a base panel extending from the bottom edge of the front panel; and an inner pivot panel extending from the base panel.

18. The carton blank of claim 17, wherein the inner dispenser panel further comprises:

a first side extension foldably connected to a first side of the inner pivot panel; and a second side extension foldably connected to a second side of the inner pivot panel.

19. The carton blank of claim 14, wherein the front panel is wider than the side panels.

20. A method of erecting a carton blank, comprising:

providing a carton blank according to claim 14;

folding the inner dispenser panel upward;

adhering at least a portion of the inner dispenser panel to an inner surface of the outer dispenser panel;

forming a generally tubular form from the front, side, and back panels;

folding the bottom panel over a bottom end of the tubular form; and folding the top panel over a top end of the tubular form.

21. The method of claim 20, wherein the at least one bottom flap comprises a first bottom flap and a second bottom flap, the method further comprising folding the first bottom flap over the bottom end before folding the bottom panel over the bottom end of the carton.

22. The method of claim 21, further comprising folding the second bottom flap over the bottom end before folding the bottom panel over the bottom end of the carton.

23. The method of claim 22, wherein the bottom panel overlaps the first bottom flap and the second bottom flap, and substantial entireties of both bottom flaps are disposed in an interior of the carton with respect to the bottom panel and abut an inner surface of the bottom panel.

24. The method of claim 21, further comprising tucking in a tuck flap extending from an end of the bottom panel.

* * * * *